US005458461A

United States Patent [19]

Lee et al.

[11] Patent Number: 5,458,461

[45] Date of Patent: Oct. 17, 1995

[54] FILM COOLED SLOTTED WALL

[75] Inventors: Ching-Pang Lee, Cincinnati; Chander Prakash, West Chester; John H. Starkweather; Ronald D. Zerkle, both of Cincinnati, all of Ohio

[73] Assignee: General Electric Company, Cincinnati, Ohio

[21] Appl. No.: 354,194

[22] Filed: Dec. 12, 1994

[51] Int. Cl.[6] ..... F01D 5/18

[52] U.S. Cl. ..... 416/97 R; 415/115; 60/757

[58] Field of Search ..... 416/97 R, 97 A; 415/115; 60/757, 756, 755

[56] References Cited

U.S. PATENT DOCUMENTS

| | | | |
|---|---|---|---|
| 3,420,058 | 1/1969 | Howald et al. | 60/757 |
| 3,515,499 | 6/1970 | Beer et al. | 416/95 |
| 4,664,597 | 5/1987 | Auxier et al. | 416/97 R |
| 4,669,957 | 6/1987 | Phillips et al. | 416/97 R |
| 4,672,727 | 6/1987 | Field | 416/97 R |
| 4,676,719 | 6/1987 | Auxier et al. | 416/97 R |
| 4,684,323 | 8/1987 | Field | 416/97 R |
| 5,261,789 | 11/1993 | Butts et al. | 416/97 R |

*Primary Examiner*—Edward K. Look
*Assistant Examiner*—James A. Larson
*Attorney, Agent, or Firm*—Andrew C. Hess; Patrick R. Scanlon

[57] ABSTRACT

A wall adapted for use in a gas turbine engine between a first fluid and a second hotter fluid includes a first side over which is flowable the first fluid, and an opposite second side over which is flowable the second fluid. An elongate slot extends partly inwardly and perpendicularly from the second side toward the first side and is provided with the first fluid through a plurality of longitudinally spaced apart holes. The holes are aligned coplanar with the slot and longitudinally inclined to effect longitudinal overlapping of the first fluid inside the slot prior to discharge therefrom as a substantially continuous film.

9 Claims, 2 Drawing Sheets

FILM COOLED SLOTTED WALL

The present invention relates generally to gas turbine engines, and, more specifically, to film cooling of walls therein such as those found in rotor blades, stator vanes, combustion liners, and exhaust nozzles, for example.

BACKGROUND OF THE INVENTION

Gas turbine engines include a compressor for compressing ambient airflow which is then mixed with fuel in a combustor and ignited for generating hot combustion gases which flow downstream over rotor blades, stator vanes, and out an exhaust nozzle. These components over which flow the hot combustion gases must, therefore, be suitably cooled to provide a suitable useful life thereof, which cooling uses a portion of the compressed air itself bled from the compressor.

For example, a rotor blade or stator vane includes a hollow airfoil the outside of which is exposed to the combustion gases, and the inside of which is provided with compressed cooling air for cooling the airfoil. Film cooling holes are typically provided through the wall of the airfoil for channeling the cooling air through the wall for discharge to the outside of the airfoil at a shallow angle relative to the flow direction of the combustion gases thereover. This forms a film cooling layer of air to protect the airfoil from the hot combustion gases for cooling the airfoil. In order to prevent the combustion gases from flowing backwardly into the airfoil through the film holes, the pressure of the cooling air inside the airfoil is maintained at a greater level than the pressure of the combustion gases outside the airfoil to ensure only forward flow of the cooling air through the film holes and not backflow of the combustion gases therein. The ratio of the pressure inside the airfoil to outside the airfoil is conventionally known as the backflow margin which is suitably greater than 1.0 for preventing backflow.

The ratio of the product of the density and velocity of the film cooling air discharged through the film holes relative to the product of the density and velocity of the combustion gases into which the film cooling air is discharged is conventionally known as the film blowing ratio. The film blowing ratio, or mass flux ratio, of the injected film cooling air to the combustion gas flow is a common indicator for the effectiveness of film attachment. Values of the film blowing ratio greater than about 0.7 to 1.5, for example, indicate the tendency for the film cooling air to lift off the surface of the airfoil near the exit of the film cooling hole, which is conventionally known as blow-off. Effective film cooling requires that the film cooling air be injected in any manner which allows the cooling air to adhere to the airfoil outside surface, with as little mixing as possible with the hotter combustion gases.

One conventionally known method to aid in obtaining effective film cooling is to inject the cooling air at a shallow angle relative to the outside surface to reduce blow-off tendency. The blow-off of film cooling air increases mixing with the hotter gases to varying extent, depending upon the severity of the blow-off. This results in a decrease in the effectiveness of the film cooling air, and, therefore, may increase the required cooling airflow which, in turn, reduces the overall efficiency of the gas turbine engine.

Another common indicator of film effectiveness is the film coverage. The coverage is generally known as the fractional amount of the airfoil outside surface which is thought to have film air injected over it, at the exit of a row of film cooling holes. An increased coverage generally, but not necessarily, means an increased film effectiveness. The maximum coverage which may be obtained for a single configuration of film cooling is 1.0.

In order to reduce the film blowing ratio, it is known to provide tapered film cooling holes which reduce the velocity of the film cooling air as it flows therethrough by the conventionally known diffusion process for improving the effectiveness of the film cooling air discharged from the hole. Excessive velocity of the air jet injected into the combustion gases creates a complex 3-D flowfield which promotes mixing between cold film and hot gases, and should be avoided if possible.

It is also conventionally known to provide a longitudinally extending slot in the airfoil wall, with the slot being fed by a plurality of longitudinally spaced apart film cooling metering holes. The slot provides a plenum of increased area relative to the collective area of the metering holes which, therefore, reduces the velocity of the film cooling air therein by diffusion prior to discharge from the slot along the wall outer surface. In addition, the provision of a slot and the effective diffusion of cooling air within this slot serves to increase the film coverage as the cooling air exits onto the airfoil outside surface. However, such slots are typically aligned with the film cooling holes at the same shallow angle to reduce blow-off tendency.

Various embodiments of film cooling holes feeding diffusion holes or slots are known and have varying degrees of complexity and effectiveness in a crowded art. Accordingly, these arrangements require relatively complex fabrication processes which increase manufacturing costs, which can be substantial for mass produced components such as turbine vanes and blades. Furthermore, the typically shallow injection angles, down to about 15°, formed at the film cooling holes and slots reduces the strength thereof at this location and require more precise manufacturing to obtain.

SUMMARY OF THE INVENTION

A wall adapted for use in a gas turbine engine between a first fluid and a second hotter fluid includes a first side over which is flowable the first fluid, and an opposite second side over which is flowable the second fluid. An elongate slot extends partly inwardly and perpendicularly from the second side toward the first side and is provided with the first fluid through a plurality of longitudinally spaced apart holes. The holes are aligned coplanar with the slot and longitudinally inclined to effect longitudinal overlapping of the first fluid inside the slot prior to discharge therefrom as a substantially continuous film.

BRIEF DESCRIPTION OF THE DRAWINGS

The invention, in accordance with preferred and exemplary embodiments, together with further objects and advantages thereof, is more particularly described in the following detailed description taken in conjunction with the accompanying drawings in which.

DESCRIPTION OF THE PREFERRED EMBODIMENT(S)

Figure 1:
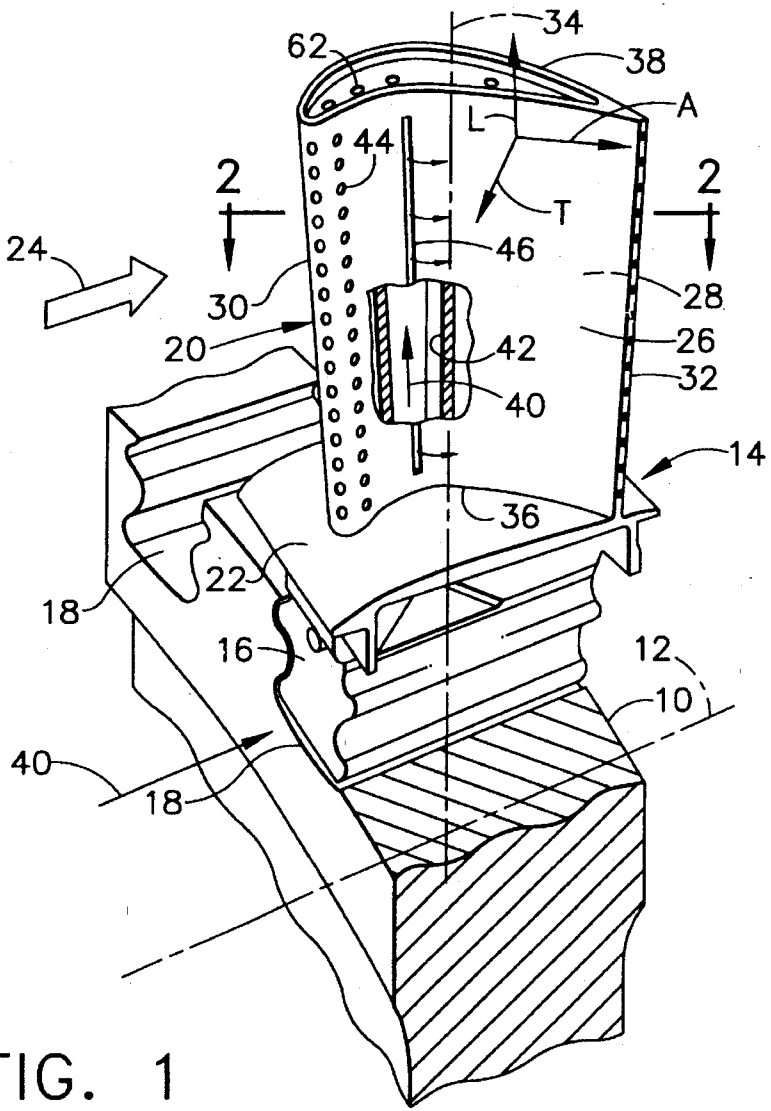
FIG. 1 is a perspective view of an exemplary gas turbine engine rotor blade joined to a portion of a rotor disk and including a film cooling slot and feedholes in accordance with one embodiment of the present invention.

Illustrated in FIG. 1 is a portion of an annular rotor disk 10 having an axial centerline axis 12 of a typical gas turbine engine turbine section. The rotor disk 10 includes a plurality of circumferentially spaced apart turbine rotor blades 14, one of which is illustrated, conventionally mounted thereto. The blade 14 includes a conventional, integral axial-entry dovetail 16 which is received in a complementary dovetail slot 18 in the rotor disk 10 for mounting the blade 14 thereto. An exemplary airfoil 20 is integrally formed with the dovetail 16 and is joined thereto at a conventional platform 22 which provides an inner flowpath for combustion gases 24 which are conventionally channeled over the airfoil 20.

The airfoil 20 conventionally includes opposite pressure and suction sidewalls 26, 28, with the former being generally concave and the latter being generally convex. The sidewalls 26, 28 are joined together at an axially upstream end along a leading edge 30, and at an opposite, axially downstream end along a trailing edge 32. The sidewalls 26, 28 also extend radially or longitudinally along a radial axis 34 from a root 36 at the platform 22 to an outer tip 38.

Cooling air 40 is conventionally bled from a compressor (not shown) of the engine and conventionally channeled upwardly through the blade dovetail 16 and into the airfoil 20 for the cooling thereof. The airfoil 20 includes an improved film cooling arrangement in accordance with an exemplary embodiment of the present invention.

Figure 2:
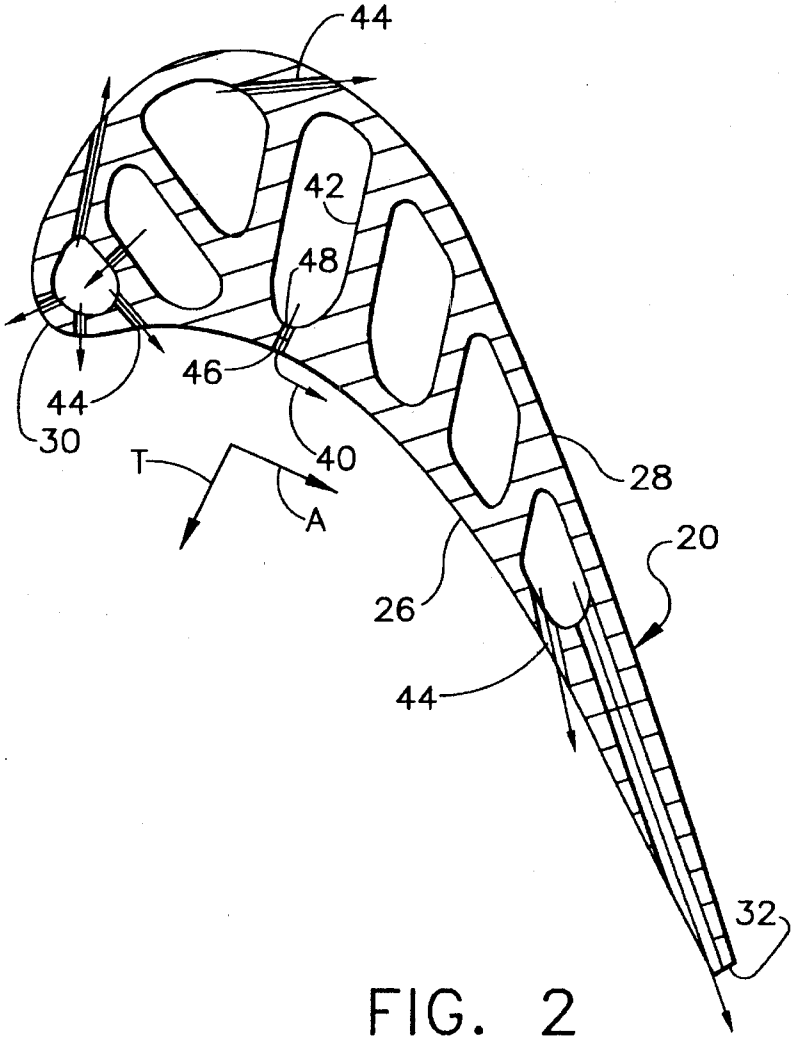
FIG. 2 is a transverse sectional view through the airfoil of the blade illustrated in FIG. 1 and taken along line 2—2.

More specifically, and referring initially to FIGS. 1 and 2, the airfoil 20 is hollow and includes a conventional cooling circuit 42 therein, which is in the exemplary form of a multi-path serpentine cooling circuit. The cooling air 40 is suitably channeled through the cooling circuit 42 for providing cooling of the various sections of the airfoil 20 in conventionally known manners. For example, disposed over the outer surface of the airfoil 20 are various rows of discrete film cooling holes 44 typically inclined through the airfoil sidewalls at relatively shallow angles for reducing blow-off tendency and improving film cooling effectiveness. However, the cooling air injected through each of the film cooling holes 44 effects a complex 3-D flowfield around the film jets and promotes mixing between the colder cooling air 40 and the hotter combustion gases 24.

In order to further improve the effectiveness of film cooling, one or more of the rows of the conventional film cooling holes 44 may be replaced by a longitudinally extending, elongate slot 46 and a row of longitudinally spaced apart metering holes or feedholes 48. The slot 46 and its feedholes 48 may be incorporated as desired in the rotor blade 14 illustrated in FIGS. 1 and 2, or in stator vanes, combustion liners, and exhaust nozzles (not shown) as desired for obtaining improved film cooling thereof in accordance with the present invention.

In the exemplary embodiment illustrated in FIGS. 1 and 2, the slot 46 and feedholes 48 (see FIG. 2) are disposed in the airfoil pressure sidewall 26 at a suitable mid-chord position between the leading and trailing edges 30, 32, for example. As shown in FIG. 1, one reference coordinate system includes the axial centerline axis 12 with respect thereto the combustion gases 24 flow generally axially downstream and over the radial extent of the airfoil 20 along the radial axis 34. A local coordinate system for the slot 46 is illustrated in FIGS. 1 and 2 and includes a longitudinal axis L which is parallel to the radial axis 34; an axial axis A which is generally similar to the axial centerline axis 12 but defines the local axial flow of the combustion gases 24 over the airfoil outer surface; and an orthogonal transverse axis T extending perpendicularly outwardly from the outer surface of the airfoil 20 at the desired location of the slot 46.

Figure 3:
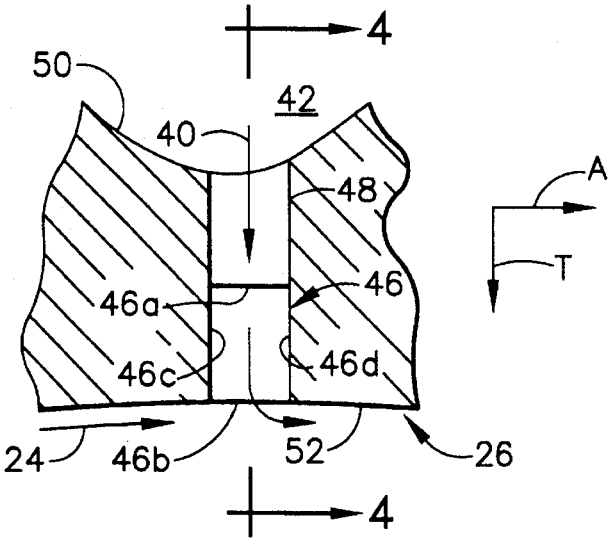
FIG. 3 is an enlarged view of the slot and holes illustrated in FIG. 2.
Figure 4:
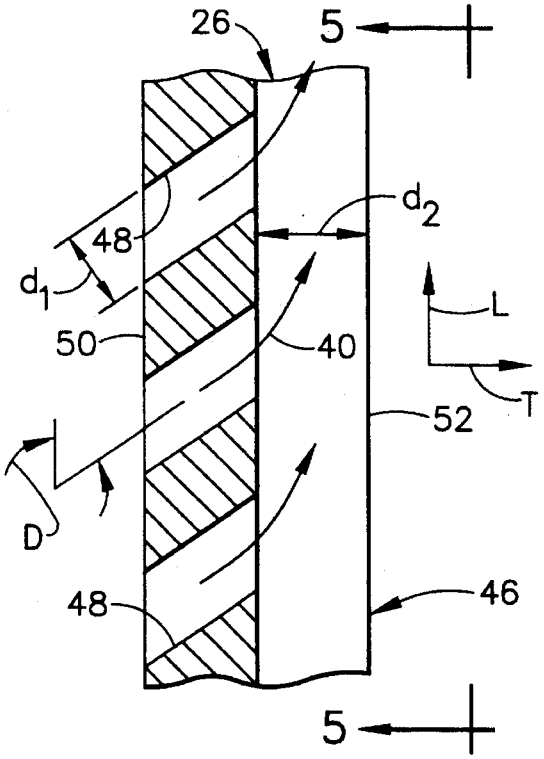
FIG. 4 is a partly sectional, longitudinal view of the slot and holes illustrated in FIG. 3 and taken along line 4—4.
Figure 5:
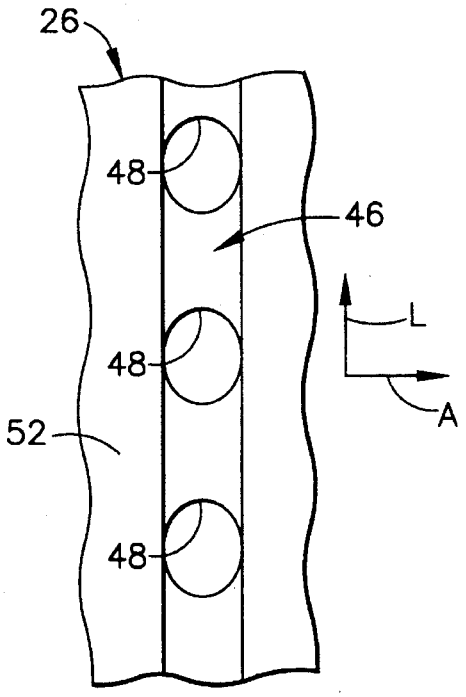
FIG. 5 is a longitudinal end view of the slot and holes illustrated in FIG. 4 and taken along line 5—5.

A preferred embodiment of the slot 46 and holes 48 is shown in more particularity in FIGS. 3–5. As shown in FIG. 3, the pressure sidewall 26 includes a first side or surface 50, which is inside the airfoil 20 and is a portion of the cooling circuit 42, and over which is flowable the cooling air 40 which is also referred to as a first fluid. The pressure sidewall 26 also includes an opposite, second side or surface 52 on the outside of the airfoil 20 which is spaced from the first side 50 along the transverse axis T, and over which is flowable the hot combustion gases 24, also referred to as a second fluid, in a downstream direction along the local axial axis A which is disposed perpendicularly to the transverse axis T.

The slot 46 extends partly inwardly and perpendicularly from the second side 52 toward the first side 50, and longitudinally along the longitudinal axis L (see FIGS. 1 and 5) which is disposed perpendicularly to both the transverse axis T and the local axial axis A. As shown in FIG. 3, the slot 46 therefore forms substantially right angle corners with the second side 52 which are substantially stronger than the acute, shallow angles typically found in conventional film cooling holes, and which are more easily manufacturable. For example, the slot 46 may be conventionally cast, or machined by laser or electrical discharge.

As shown in FIGS. 4 and 5, the plurality of feedholes 48 are longitudinally spaced apart from each other and extend outwardly from the first side 50 to the slot 46 in flow communication therewith for channeling thereto the cooling air 40. In accordance with the present invention, the holes 48 are coplanar or transversely aligned parallel with the slot 46 as shown in FIG. 3, and longitudnally inclined at an acute hole discharge angle D relative to the longitudinal axis L, as illustrated in FIG. 4, for discharging the cooling air 40 into the slots 46 for obtaining longitudinal overlapping thereof prior to discharge from the slot 46 as a substantially two dimensional (2-D) sheet of film cooling air having substantially continuous coverage.

Since the slot 46 is not disposed through the sidewall 26 at a shallow inclination angle with the outer second side 52, it eliminates the undesirable shallow or sharp corners which are difficult to manufacture and have reduced strength. However, since the feedholes 48 are aligned coplanar with the slot 46 along the transverse axis T as shown in FIG. 3, little effective length is provided through the relatively thin sidewall 26 for reducing the velocity of the cooling air jets being discharged from the holes 48. Unless the jet velocity is suitably reduced, the jets will extend outwardly from the slot 46 and create undesirable 3-D flowfields in the combustion gases 24 which undesirably promotes mixing between the colder cooling air 40 and the hotter combustion gases 24, as well as promotes premature separation of the cooling air film downstream therefrom.

Accordingly, the several feedholes 48 as illustrated in FIG. 4 are preferably disposed parallel to each other, with all of the holes 48 being longitudinally inclined at the same acute hole discharge angle D for allowing the cooling air 40 to firstly travel in part longitudinally or radially upwardly inside the slot 46 which shields the cooling air 40 from the combustion gases 24 and allows the cooling air 40 to longitudinally overlap with the cooling air 40 from adjacent ones of the holes 48. The cooling air 40 itself then mixes together in the slot 46 without entraining the combustion gases 24 therewith, and allows diffusion and a reduction in velocity of the mixing cooling air 40 within the slot 46. The cooling air 40 then spills outwardly over the longitudinal extent of the slot 46 to form a substantially continuous sheet of cooling air film which flows downstream from the slot 46 along the local axial axis A for providing an improved film cooling boundary layer with enhanced film coverage and effectiveness.

As shown in FIG. 3, the slot 46 may be relatively simple in configuration and includes a longitudinally extending inlet 46*a* at the inside end thereof which is disposed in flow communication with the outlet ends of the holes 48. The slot 46 also includes a longitudinally extending outlet 46*b* in the second side 52 of the sidewall 26 which is disposed parallel to the slot inlet 46*a*. A pair of opposite, preferably flat slot sidewalls 46*c* and 46*d* face each other and extend transversely between the slot inlet 46*a* and outlet 46*b*. As shown in FIG. 1, the slot 46 may have any suitable length between its top and bottom ends in the airfoil 20.

Referring again to FIG. 3, the slot sidewalls 46*c,d* are preferably parallel to each other, and both are perpendicular to the second side 52 of the sidewall 26, and therefore have a substantially constant flow area along the transverse axis T. Accordingly, the slot sidewalls 46*c,d* do not provide diffusion along the transverse axis T, but diffusion nevertheless is effected by the slot 46 having a larger exit area than the discharge area of the collective holes 48, and by allowing the cooling air 40 to initially flow longitudinally in the slot 46 for effecting diffusion in that longitudinal direction for collectively reducing the velocity of the cooling air 40 as it is discharged from the slot outlet 46*b*.

As shown in FIG. 4, the several feedholes 48 preferably have substantially equal, circular diameters $d_1$, and the slot 46 has a depth $d_2$ along the transverse axis T which is preferably at least twice the hole diameter $d_1$. In this way, an effective volume is created within the slot 46 for allowing longitudinal overlap of the cooling air 40 discharged from the feedholes 48, and effective diffusion thereof for creating the 2-D film cooling layer discharged from the slot 46.

In the exemplary embodiment illustrated in FIG. 4, the hole discharge angle D is about 30° which, with the depth $d_2$ to diameter $d_1$ ratio preferred above, provides effective mixing and diffusion of the cooling air 40 prior to discharge from the slot 46.

As indicated above, since the slot 46 is perpendicular to the sidewall 26, it may be relatively easily manufactured by casting or suitable machining. The longitudinally or radially inclined feedholes 48 may then be easily formed by conventional drilling by lasers, electrical discharge machining, or electrochemical electrostream machining. The perpendicular slot 46 and aligned feedholes 48 may also be suitably used in stator vanes, combustion liners, or exhaust nozzle flaps instead of conventional rows of inclined film cooling holes.

While there have been described herein what are considered to be preferred and exemplary embodiments of the present invention, other modifications of the invention shall be apparent to those skilled in the art from the teachings herein, and it is, therefore, desired to be secured in the appended claims all such modifications as fall within the true spirit and scope of the invention.

Accordingly, what is desired to be secured by Letters Patent of the United States is the invention as defined and differentiated in the following claims:

We claim:

1. A wall adaptable for use in a gas turbine engine between a first fluid and a hotter second fluid comprising:

a first side over which is flowable said first fluid;

an opposite second side spaced from said first side along a transverse axis and over which is flowable said second fluid in a downstream direction along an axial axis disposed perpendicularly to said transverse axis;

an elongate slot extending partly inwardly and perpendicularly from said second side toward said first side and longitudinally along a longitudinal axis disposed perpendicularly to both said transverse axis and said axial axis;

a plurality of longitudinally spaced apart holes extending outwardly from said first side to said slot in flow communication therewith for channeling thereto said first fluid; and said holes being coplanar with said slot and longitudinally inclined at an acute hole discharge angle relative to said longitudinal axis for discharging said first fluid into said slot for obtaining longitudinal overlapping thereof prior to discharge from said slot for film cooling said wall second side.

2. A wall according to claim 1 wherein said holes are parallel to each other.

3. A wall according to claim 2 wherein said slot comprises:

an inlet disposed in flow communication with said holes;

an outlet in said wall second side disposed parallel to said slot inlet; and a pair of opposite sidewalls facing each other and extending transversely between said slot inlet and outlet.

4. A wall according to claim 3 wherein said slot sidewalls are flat.

5. A wall according to claim 4 wherein said slot sidewalls are parallel to each other and perpendicular to said wall second side.

6. A wall according to claim 5 wherein said holes have substantially equal diameters, and said slot has a depth along said transverse axis at least twice said hole diameter.

7. A wall according to claim 6 wherein said hole discharge angle is about 30°.

8. A wall according to claim 7 wherein:

said wall is a portion of a gas turbine engine airfoil;

said slot extends in a radial direction perpendicularly to flow of said second fluid over said wall and faces outwardly, with said holes facing inwardly into said airfoil; and said airfoil is hollow for channeling therethrough said first fluid into said holes for flow through said slot to film cool said airfoil from heating by said second fluid flowable thereover.

9. A gas turbine engine airfoil according to claim 8 further comprising a leading edge, a trailing edge, a pressure sidewall, and a suction sidewall; and said slot is disposed in said airfoil pressure sidewall between said leading and trailing edges.

* * * * *